United States Patent [19]

Lee et al.

[11] Patent Number: 5,050,832

[45] Date of Patent: Sep. 24, 1991

[54] MODULAR STORAGE UNIT MOUNTING SYSTEM

[75] Inventors: E. Desmond Lee; Charles Camilleri, both of St. Louis, Mo.

[73] Assignee: Lee/Rowan Company, St. Louis, Mo.

[21] Appl. No.: 524,807

[22] Filed: May 18, 1990

[51] Int. Cl.[5] ..... E04G 5/06

[52] U.S. Cl. ..... 248/225.2; 248/222.2; 248/692; 312/245

[58] Field of Search ..... 248/224.2, 225.2, 222.2, 248/489, 323, 339, 340, 692; 312/245, 246

[56] References Cited

U.S. PATENT DOCUMENTS

| | | | |
|---|---|---|---|
| 1,772,504 | 8/1930 | Vrooman | 248/692 |
| 3,337,172 | 8/1967 | Jackson | 312/245 X |
| 3,532,317 | 10/1970 | Adler | 248/225.2 |
| 3,669,035 | 6/1972 | Grossman | 248/225.2 X |
| 3,908,831 | 9/1975 | Brendgord | 312/245 X |
| 4,008,872 | 2/1977 | Thompson | 248/224.2 |
| 4,311,295 | 1/1982 | Jamar, Jr. | 248/225.2 X |
| 4,669,690 | 6/1987 | McEniry | 248/222.2 X |
| 4,848,858 | 7/1989 | Suzuki | 312/246 |

FOREIGN PATENT DOCUMENTS

| | | | |
|---|---|---|---|
| 3001567 | 7/1981 | Fed. Rep. of Germany | 312/246 |
| 2404411 | 6/1979 | France | 248/225.2 |

*Primary Examiner*—Gary L. Smith
*Assistant Examiner*—Suzanne L. Dino
*Attorney, Agent, or Firm*—Rogers, Howell & Haferkamp

[57] ABSTRACT

An adjustable mounting system for removably supporting modular storage units on a vertical wall is comprised of at least two substantially identical C-shaped brackets and a wall channel. The C-brackets are adjustably mounted on a storage unit, and one of two opposed hooks on each bracket is hooked over the wall channel to mount the storage unit on the channel. The C-brackets also include an outboard flange with a slot and screw hole, providing the adjustable mounting of the bracket to the modular storage unit.

18 Claims, 1 Drawing Sheet

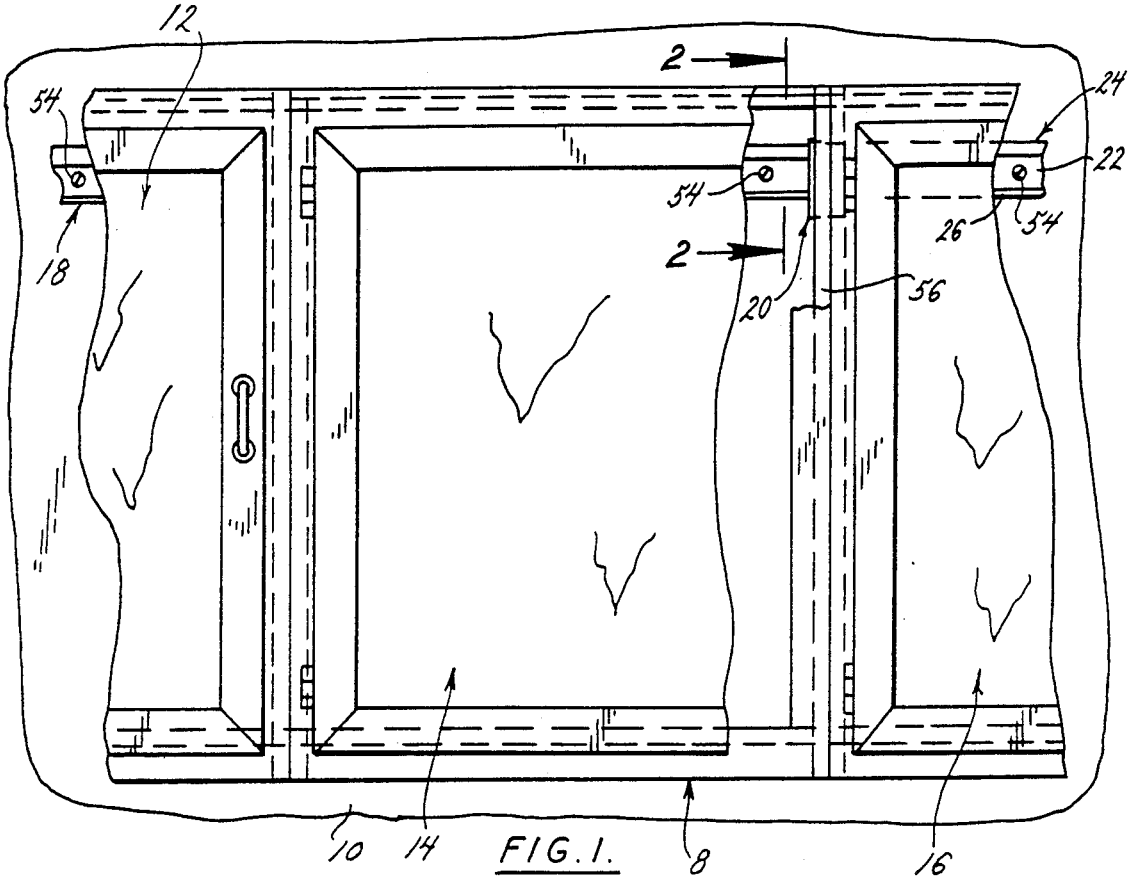
FIG. 1.
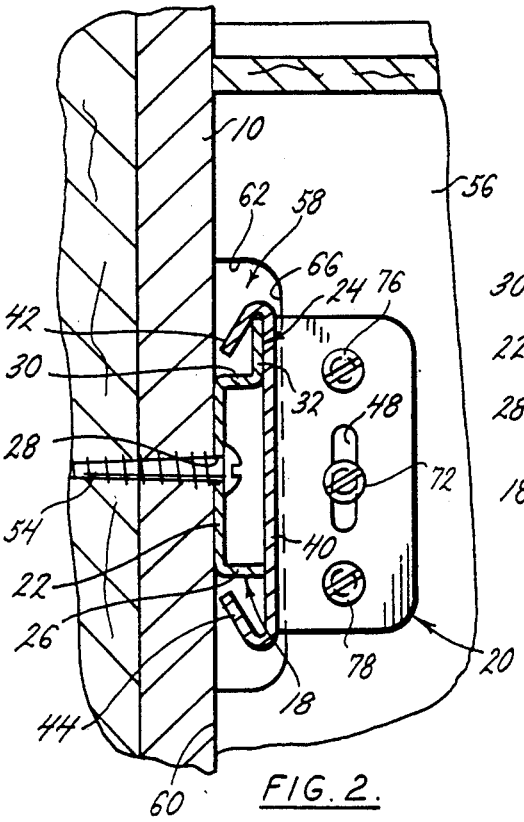
FIG. 2.
FIG. 3.
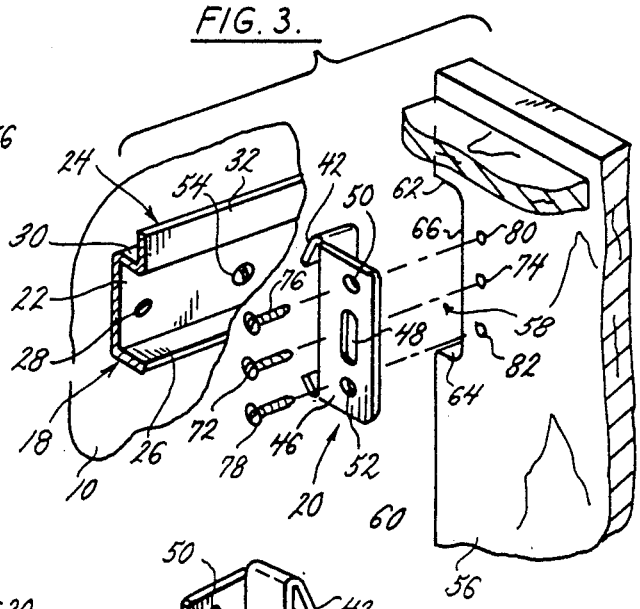
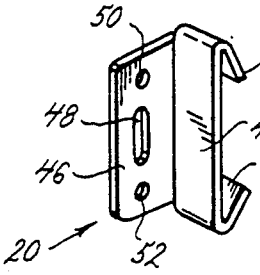
FIG. 4.

MODULAR STORAGE UNIT MOUNTING SYSTEM

BACKGROUND OF THE INVENTION

1) Field of the Invention

The present invention relates to an apparatus for the mounting of a plurality of modular storage units such as shelving or cabinet units. More specifically, the apparatus comprises brackets that are adjustably secured to a modular storage unit, and a wall rail for mounting the brackets and the secured storage unit to a vertical wall. The brackets are configured as symmetrical parts, so that identical brackets are mounted on opposite sides of the modular storage unit, and are used to detachably engage the wall rail which has been secured in a horizontal fashion to a vertical wall to suspend the storage unit on the wall.

2) Description of the Related Art

In providing modular cabinet or shelving storage units for home or office use, it is often desirable to have some degree of flexibility in the mounting system of the storage units so that the units can be moved about while being mounted in order to level the units, and so that the units can be easily removed and interchanged, or mounted in different orientations as needs vary. This flexibility is best achieved with a minimum number of component parts in the mounting system to reduce costs, while providing storage units that are sturdy and stable when mounted.

Various devices have been developed for the mounting of cabinets and shelving on a wall. U.S. Pat. No. 4,160,570 discloses an example of wall mounted modules for merchandising and storage. The modules are mounted by a transversely extending bar that is secured to a vertical wall. The bar is provided with an upwardly opening channel, and each module is specially formed with a portion that protrudes out from, and extends downward over, a recess formed in the back of the module. The protruding portion of the module is inserted into the channel of the bar to suspend the module from the bar.

These types of wall mounting systems are disadvantaged in that they do not provide a mechanism for leveling the separate modules from side to side apart from leveling the transverse bar. They are also disadvantaged in that the modules are each formed with the specialized protruding portion and recess on their back surfaces, which increase the costs of producing the modules over those without such a specialized construction.

U.S. Pat. No. 4,133,507 also discloses a system for mounting modular storage units to a wall. This system includes a wall rail that is mounted transversely to a vertical wall, and a mounting key that is inserted in horizontally extending slots in the wall rail and the storage module to mount the module to the rail. A leveling key is also disclosed. The leveling key is inserted into a leveling slot in the back of the module, and spaces the bottom of the storage module out from the vertical wall to level the horizontal surfaces of the module from front to back. The key does not, however, remedy side-to-side leveling. In this system also, the storage module is leveled from side to side by leveling the wall rail horizontally o the wall. This system is also disadvantaged in that the many different component parts of the system increase its cost of production.

It is an object of the present invention to provide a cabinet mounting system that overcomes the disadvantages of prior art systems addressed above. The present invention provides a cabinet mounting system with apparatus for leveling individual cabinets or shelving units mounted by the system in two planes. The invention permits the cabinet modular units to be mounted flush against a vertical wall to level the modular units from front to back, and also permits the adjustment of the modular unit mounting to the wall to level the unit from side to side. Furthermore, the storage unit mounting system of the invention is provided with symmetrical mounting hardware that is adapted to be used on both sides of the storage unit to mount the unit to the wall. The symmetric design of the mounting hardware reduces the number of different parts in the mounting system, and accordingly reduces the cost of producing the mounting system and the complexity of the assembly process.

SUMMARY OF THE INVENTION

The cabinet mounting system of the present invention comprises a wall channel that is secured to the structural components of a vertical wall, and C-brackets that are adjustably attached to modular cabinet components and detachably engage the wall channel, thereby detachably mounting the modular cabinet components to the wall channel.

The wall channel is composed of three parallel, coextensive sections; a center section, a first flange section, and a second flange section. The center section has holes spatially arranged along the entire length of the channel. The holes are provided to facilitate the securing of the wall channel to a vertical wall by threaded fasteners or other similar fastener means. When attached to the wall, the first flange section extends out from the upper edge of the center section perpendicular to the wall, and then projects upward above the center section of the wall channel. The second flange section extends out from the lower edge of the center section perpendicular to the wall, and serves as a stop to limit rotation of the modular unit about the wall channel after the unit is hung on the first flange section, thereby aiding in leveling the unit horizontally out from the wall.

The C-brackets of the cabinet mounting system are used to releasably and adjustably attach the modular storage units to the wall channel. Each C-bracket comprises two mutually opposed hook elements connected by a flat center section, and an outboard flange that is perpendicular to the center section. The flange extends rearward from the hook elements and runs the length of the center section between each hook. A slot is provided in the flange for attachment of the flange to a sidewall of a storage unit by a threaded fastener or other similar fastener means. The slot is also used in adjusting the position of the bracket relative to the storage unit in the side to side leveling of the storage unit o the wall channel. Two additional holes are provided in the flange to secure the adjusted bracket to the storage unit sidewall by an additional pair of threaded fasteners. Each C-bracket is configured as a symmetric part, with the opposite ends of the bracket having the opposed hook elements being mirror images of each other. This enables the same bracket to be used on opposite sides of the storage unit to mount the unit to the wall channel in a manner to be explained.

A primary objective of the present invention is to provide a sturdy modular storage system that is easily assembled and leveled on a vertical wall. To accomplish this objective, an effective method of transferring the storage unit load to the wall is essential. The first step in obtaining this sturdy mounting system is to provide an approach by which the wall channel is securely attached to the wall itself. The wall channel is first placed against the wall in a horizontally leveled position, and is preferably mounted to the vertical wall by threaded fasteners. The fasteners pass through the holes provided in the channel's center section, through the wall board of the vertical wall, and are finally anchored into the support studs of the wall, thereby securing the channel in its desired, horizontally leveled position to the wall.

At least two of the C-brackets are next adjustably attached to opposite vertical sidewalls of the cabinet or shelving storage unit to be mounted on the wall. The storage units of the type employed with the present invention generally comprise at least two vertical sidewalls. The sidewalls are prepared for the mounting of the C-brackets by first cutting a recess in the back edge of each of the sidewalls to accommodate the brackets. The recesses compensate for the distance that the wall channel protrudes out from the wall, and allows the back edges of the storage unit sidewalls to contact flush with the surface of the wall on which the modular unit is mounted. A C-bracket is placed in each pre-cut recess, with the flange of each bracket overlapping a portion of the unit sidewall.

The aforementioned slot in the flange of the C-brackets and the two accompanying holes provide a means for leveling the storage unit on the wall channel, and for securing the unit in its adjusted level position on the channel. Attachment of the C-brackets to the sidewalls of the storage unit is accomplished by inserting a threaded fastener through each flange slot and into a predrilled hole in the unit sidewalls, while positioning the bracket in an upper most position in the recess in the back of the sidewall. The fasteners are then tightened down in the holes to hold the C-brackets in their uppermost positions. The storage units are then lifted, and hung on the wall channel that has previously been secured to the vertical wall in a horizontally leveled position. Mounting and removing the modular storage units to and from the wall channel is a simple and straightforward procedure. The topmost hook elements of the C-brackets are raised above the upwardly projecting flange of the wall channel, and are then lowered onto the upward projecting flange. The unit is then checked to see if it hangs level on the wall channel from side to side. If the unit is not level, the lower side of the unit is raised until the unit is level. After the storage unit is leveled in this manner, notice is then taken of how much the C-bracket on the raised side of the storage unit has to be lowered in order for it to engage over the upward projecting flange of the wall channel. The storage unit is then lowered from the wall, and the C-bracket is adjusted downward the needed amount by loosening the threaded fastener in the slot of the C-bracket, adjusting the bracket downward, and retightening the fastener. The storage unit is then rehung on the wall channel and again checked to see if it hangs level from side to side. If the unit is not yet level, the above procedure of raising the lower side of the unit and adjusting the C-bracket is repeated. If the storage unit now hangs level on the wall channel, additional holes are drilled into the sidewalls of the storage unit through the holes at the opposite ends of the C-bracket slots, and threaded fasteners are screwed into the drilled holes through the holes of the brackets to secure the two C-brackets to the sidewalls of the storage unit in their adjusted positions relative to the unit.

The present invention provides a secure system for mounting one or more storage units in horizontally leveled positions on a vertical wall. The mounting system is both simple to assemble and inexpensive to produce, yet affords substantially the same flexibility in mounting the storage units as more expensive prior art systems employing greater numbers of component parts.

BRIEF DESCRIPTION OF THE DRAWINGS

Further objects and features of the present invention are revealed in the following detailed description of the preferred embodiment of the invention and in the drawing figures wherein:

FIG. 1 is a partially cut-away, front elevation view of an operative environment of the present invention;

FIG. 2 is a side elevation view in section of the mounting system of the present invention;

FIG. 3 is an exploded, view, in section, of the mounting system of the invention; and FIG. 4 is a perspective view of a C-bracket of the mounting system of the invention.

DETAILED DESCRIPTION OF THE PREFERRED EMBODIMENT

FIG. 1 shows a preferred operative environment of the present invention including a modular storage unit 8 suspended on a vertical wall 10. The modular storage unit 8 is shown comprised of three separate cabinet units 12, 14, 16, however it should be understood that the storage unit shown is only illustrative, and the mounting system of the present invention is equally well suited for mounting a variety of other types of storage units. The storage unit 10 is shown suspended on the wall by the mounting system of the present invention that is generally comprised of a wall channel 18 and a pair of adjustable C-brackets 20.

The wall channel 18 of the present invention is generally comprised of a center section 22, a top flange section 24, and a bottom flange section 26. The center section 22 is generally a flat, rectangular strip that is adapted to be placed flat against the vertical wall 10 and secured thereto. Spatially arranged along the center section 22 are a plurality of holes 28. In the preferred embodiment, the holes 28 are spaced 16 inches apart to correspond the spacing of the holes 28 with the common spacing of vertical wall studs. However, the hole spacing may be less than 16 inches if so desired, and additional holes may be drilled through the center section 22 by the channel installer to adapt the wall channel for mounting in a variety of situations. The bottom flange section 26 extends perpendicularly outward from the bottom edge of the center section 22 along the entire length of the wall channel. With the wall channel secured to the vertical wall, the bottom flange 26 will also extend outward perpendicular to the wall. The top flange section 24 is formed at an angle, with a first portion of the angle 30 extending outward from, and perpendicular to, a top edge of the center section 22, and a second portion 32 extending upward from the first portion 30, parallel with the center section 22. The first portion 30 of the top flange 24 extends outward from the center section 22 to the same extent as the bottom flange section 26. Both the top flange section 24 and the bottom flange section 26 extend along the entire length of the wall channel 18.

The configuration of the C-brackets 20 of the present invention is best seen in FIG. 4. Each C-bracket 20 includes a flat middle section 40. Opposite ends of the flat section 40 are formed as hooks 42, 44 that are bent over one side of the flat section. A mounting flange 46 extends perpendicular to the side of the flat section 40 opposite the side overlapped by the pair of hooks. The mounting flange 46 extends along the entire length of the C-bracket flat section 40 and is provided with a slot 48 extending through the flange, and a pair of mounting holes 50, 52 extending through the flange at opposite ends of the slot.

The first step involved in mounting storage units using the mounting system of the present invention is to mount the wall channel 18 in a horizontally leveled position on the vertical wall 10 where the storage units are desired. The wall channel 18 is placed against the wall 10 at the desired height, with the top and bottom flanges 24, 26 extending outward from the wall. The system installer then adjusts the position of the wall channel 18 until it is leveled from side to side. With the wall channel 18 held in its leveled position against the wall 10, the installer inserts a plurality of threaded fasteners 54 or other similar fastener means through the holes 28 in the center section 22 of the wall channel and into the vertical wall 10, thereby securing the wall channel in its leveled position to the vertical wall.

Next, the vertical sidewalls 56 of the cabinet or storage unit to be mounted to the wall are modified by cutting vertical recesses 58 in the rearward or wall abutting edges 60 of the sidewalls 56. The recesses 58 are dimensioned at least as large as the flat section 40 of the C-brackets, and are preferably dimensioned slightly larger to permit adjustment of the position of the C-bracket in the recess. As best seen in FIG. 2, the recess 58 has been dimensioned so that the C-bracket 20 may be adjustably positioned in the recess 58 between the top most edge 62 of the recess and the bottom most edge 64 of the recess.

After the recesses have been cut into the back edges of the sidewalls, a C-bracket 20 is positioned adjacent the top edge 62 of each recess. The top and bottom halves of the C-bracket are symmetric, and identical brackets are mounted in each recess with the flat section 40 of the bracket abutting against the vertical edge 66 of the recess, and the C-bracket mounting flange 46 laying flat against the sidewall 56. In this position, a first threaded fastener 72, or other similar fastening means, is inserted through the slot 48 of the mounting flange 46, and is screwed into a predrilled hole 74 in the sidewall 56. The screws 72 are tightened down to hold the C-brackets 20 at the top edges 62 of each recess 58 in the opposite sidewalls 56 of the storage unit. With the C-brackets 20 secured to the sidewalls 56 of the storage unit, the storage unit is next mounted onto the wall channel 18 that has been secured in a horizontally leveled position on the wall.

In mounting the C-brackets 20 to the wall channel 18, the upper most hook 42 of the bracket is placed over the top edge of the second portion 32 of the wall channel top flange 24. The entire storage unit is then lowered until the top hooks 42 of each of the brackets 20 engage over the wall channel top flange second portion 32 and suspended the storage unit from the wall channel. In this position of the wall brackets 20, the bottom flange section 26 of the wall channel abuts against the flat section 40 of the C-brackets, and the back edges 60 of the storage unit sidewalls 56 abut flush against the vertical wall 10 to level the storage unit from front to back.

If the cabinet is not level from side to side, the installer next carefully lifts the lower sidewall of the unit until the unit is level, and then notes how much the bracket 20 on that sidewall has to be lowered in order to engage the top hook 42 of the bracket on the wall channel top flange 24. Next, the cabinet is lowered down from the wall channel 20 to adjust the position of that bracket 20 downward. The position of the bracket 20 relative to the sidewall 56 is adjusted by loosening the threaded fastener 72, and then moving the bracket 20 downward in the recess 58 the needed amount. Upon completion of this procedure, the screw 72 is retightened. The brackets 20 on both of the sidewalls 56 are then secured in their adjusted positions by inserting additional threaded fasteners 76, 78, or other similar fasteners, through the pair of holes 50, 52 in the bracket 20, and into holes 80, 82 provided in the sidewall 56 of the unit. Beside drilling the holes 80, 82, the holes may be provided in the storage unit sidewalls by using a nail or an awl and tapping with a hammer. With the C-brackets securely attached to the storage unit, the unit is then hung in its leveled orientation on the wall 10 in the manner discussed above.

In the manner described above, the mounting system of the present invention easily mounts a storage unit to a vertical wall in a position that is leveled from left to right and forward to back. The top and bottom hooks 42, 44 of each of the C-brackets permit the storage unit to be easily removed from the wall channel 20 by merely raising the unit and then pulling the unit forward away from the wall. The symmetric design of the C-brackets also permit the same bracket to be used on opposite sidewalls of the storage unit, reducing the number of different component parts of the mounting system, and accordingly, reducing the cost of producing the system.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. A storage unit mounting system adapted to detachably mount a modular storage unit to a wall in a horizontally and vertically adjusted position relative to the wall, the system comprising:

a wall channel member having a predetermined length and adapted to be mounted to a vertical wall; and bracket means adapted to be adjustably secured to a modular storage unit and detachably attached to the wall channel member mounted on the vertical wall to thereby detachably suspend the modular storage unit on the vertical wall, the bracket means being further adapted to be moved relative to the storage unit once secured thereto to enable the adjustment of the orientation of the storage unit on the wall.

2. The storage unit mounting system of claim 1 wherein:

the bracket means includes an adjustable connection means, the connection means being adapted to be adjustably secured to a storage unit to enable movement of the bracket means relative to the storage unit, and the connection means being adapted to be fixedly secured to the storage unit to prevent movement of the bracket means relative to the storage unit.

3. The storage unit mounting system of claim 2 wherein:

the connection means is adapted to be fixedly attached to the storage unit after it is first adjustably attached to the storage unit.

4. The storage unit mounting system of claim 2 wherein:

the connection means includes a flange and a first opening through the flange, the opening being dimensioned to receive a first fastener inserted through the opening and secured to the storage unit, and to enable limited relative movement between the connection means and the fastener.

5. The storage unit mounting system of claim 4 wherein:

the first opening through the flange of the connection means is a slot.

6. A storage unit mounting system adapted to detachably mount a modular storage unit to a wall in a horizontally and vertically adjusted position relative to the wall, the system comprising:

a wall channel member having a predetermined length and adapted to be mounted to a vertical wall;

bracket means adapted to be adjustably secured to a modular storage unit and detachably attached to the wall channel member mounted on the vertical wall to thereby detachably suspend the modular storage unit on the vertical wall, the bracket means being further adapted to be moved relative to the storage unit once secured thereto to enable the adjustment of the orientation of the storage unit on the wall;

the bracket means includes an adjustable connection means, the connection means being adapted to be adjustably secured to a storage unit to enable movement of the bracket means relative to the storage unit, and the connection means being adapted to be fixedly secured to the storage unit to prevent movement of the bracket means relative to the storage unit;

the connection means includes a flange and a first opening through the flange, the opening being dimensioned to receive a first fastener inserted through the opening and secured to the storage unit, and to enable limited relative movement between the connection means and the fastener; and a second opening extends through the flange of the connection means and is dimensioned to receive a second fastener inserted through the second opening and secured to the storage unit to prevent relative movement between the connection means and the storage unit.

7. The storage unit mounting system of claim 1 wherein:

each bracket means includes an attachment means, the attachment means being adapted to be detachably attached to the wall channel member in a first and a second position relative to the wall channel member, the second position of the attachment means being an upside-down inversion of the first position of the attachment means.

8. The storage unit mounting system of claim 7 wherein:

the bracket attachment means is symmetrical about a horizontal axis of the attachment means.

9. The storage unit mounting system of claim 7 wherein:

the bracket attachment means includes mutually opposed first and second hook members at opposite ends of the attachment means, the first hook member is adapted to detachably attach the attachment means to the wall channel member in the first position relative to the channel member, and the second hook member is adapted to detachably attach the attachment means to the wall channel member in the second position relative to the channel member.

10. The storage unit mounting system of claim 1 wherein:

the wall channel member includes a center mounting section, a top rail section, and a bottom spacer section, the three sections of the channel member are coextensive and parallel to each other over the length of the channel member, and the center mounting section is adapted to be secured to the vertical wall to mount the channel member to the wall.

11. The storage unit mounting system of claim 10 wherein:

the top rail section of the channel member is laterally displaced outward from the center mounting section.

12. The storage unit mounting system of claim 11 wherein:

the bottom spacer section of the channel member is positioned relative to the center section to project outward perpendicular to the vertical wall.

13. A storage unit mounting system for removably hanging a modular storage unit on a wall comprising:

a wall channel member adapted to be secured to a wall in a general horizontally leveled orientation; and at least two bracket means adapted to be adjustably attached to opposite sides of a storage unit and adapted to be connected to the wall channel to hang the storage unit from the channel, the adjustable attachment of the bracket members to the storage unit enabling the adjustment of the orientation of the storage unit relative to the wall channel.

14. The mounting system of claim 13 wherein:

a slot is provided in each of the bracket members, and a fastener extends through the slot and is secured to a side of the storage unit, thereby adjustably attaching the bracket member to the storage unit.

15. A storage unit mounting system for removably attaching a modular storage unit to a wall, the system comprising:

a wall channel member adapted to be secured to a wall in a general horizontal orientation; and at least two substantially identical brackets, one bracket being secured to the storage unit in a first orientation of the bracket relative to the storage unit, and a second bracket being secured to the storage unit in a second orientation of the bracket relative to the storage unit, the second orientation being an upside-down inversion of the first orientation, the two brackets detachably attaching the storage unit to the wall channel member.

16. The mounting system of claim 15, wherein:

the bracket means is symmetrical about a horizontal axis of the bracket means.

17. A method of mounting a storage unit in a leveled position to a wall, the method comprising the steps of:

providing a wall channel adapted to be secured to a wall, the wall channel having at least one flange extending therefrom;

securing the wall channel in a leveled position to the wall with the flange of the wall channel extending outward from the wall;

providing bracket means to be both adjustably secured and fixedly secured to a storage unit;

adjustably securing the bracket means to the storage unit;

mounting the storage unit on the wall by engaging the bracket means on the wall channel flange;

adjusting the position of the storage unit mounted on the wall to a leveled position; and fixedly securing the bracket means to the storage unit with the bracket means engaging the wall channel flange and the storage unit mounted in a leveled position on the wall.

18. The method of claim 17, further comprising:

prior to fixedly securing the bracket means to the storage unit, adjusting the bracket means relative to the leveled storage unit to reengage the bracket means on the wall channel flange.

* * * * *